United States Patent [19]

Ackermann

[11] 4,069,043

[45] Jan. 17, 1978

[54] WEAR-RESISTANT SHAPED MAGNETIC ARTICLE AND PROCESS FOR MAKING THE SAME

[75] Inventor: Friedrich W. Ackermann, Wyomissing, Pa.

[73] Assignee: Carpenter Technology Corporation, Reading, Pa.

[21] Appl. No.: 650,259

[22] Filed: Jan. 19, 1976

[51] Int. Cl.[2] ..... B22F 3/00

[52] U.S. Cl. ..... 75/232; 75/171; 75/170; 75/206; 75/246

[58] Field of Search ..... 29/182.5; 75/206, 170, 75/171, 232, 246

[56] References Cited

U.S. PATENT DOCUMENTS

| | | | |
|---|---|---|---|
| 3,440,042 | 4/1969 | Kaufmann | 75/206 |
| 3,661,570 | 5/1972 | Moss | 29/182.5 |
| 3,739,445 | 6/1973 | Gabriel et al. | 75/206 |
| 3,814,598 | 6/1974 | Gabriel et al. | 29/182.5 |
| 3,895,942 | 7/1975 | Morse | 75/206 |

*Primary Examiner*—Brooks H. Hunt
*Attorney, Agent, or Firm*—Edgar N. Jay

[57] ABSTRACT

Shaped magnetic articles made from powder material are provided containing about 70 to 85% nickel, more than 10% iron, one or more of 0 to 5% chromium, 0 to 6% molybdenum, 0 to 6% copper, 0 to 2% manganese, 0 to 1% titanium and 0 to 1% niobium, containing also about 0.1 to 2.0% of a refractory metal oxide, and having a unique combination of magnetic and physical properties. A process for making the shaped magnetic articles from metal powder and refractory oxide is also disclosed by which the metal and refractory oxide powder are blended, sintered and worked to provide substantially homogeneous articles having at least 99% theoretical density.

29 Claims, 1 Drawing Figure

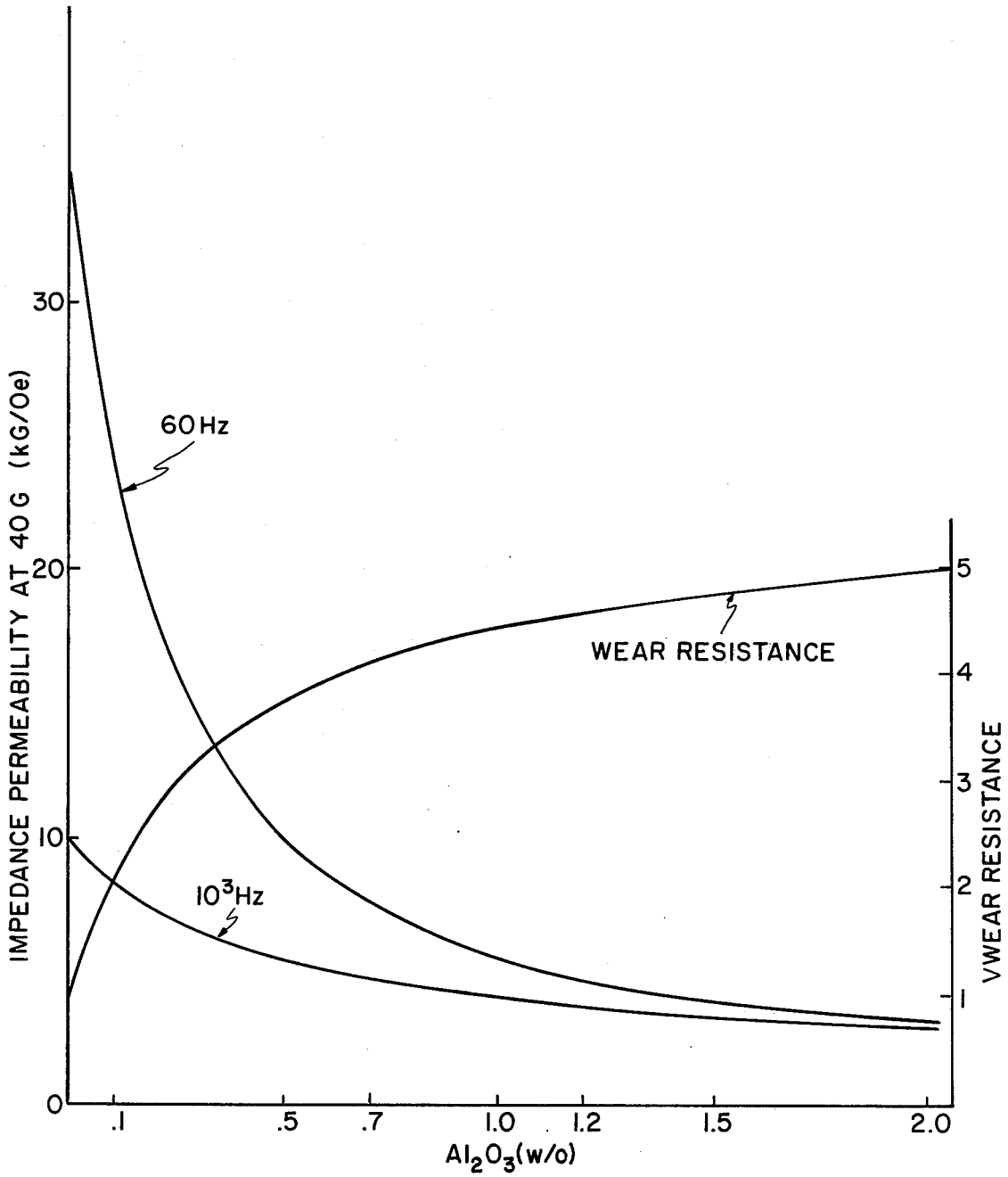
IMPEDANCE PERMEABILITY AT 40 G (kG/Oe)
30
20
10
0
60 Hz
$10^3$Hz
WEAR RESISTANCE
VWEAR RESISTANCE
5
4
3
2
1
.1
.5
.7
1.0
1.2
1.5
2.0
$Al_2O_3$(w/o)

WEAR-RESISTANT SHAPED MAGNETIC ARTICLE AND PROCESS FOR MAKING THE SAME

BACKGROUND OF THE INVENTION

This invention relates to a highly densified composite shaped article and a method of making the same from powder material and, more particularly, to such a shaped article having a unique combination of magnetic and physical properties made from powder materials by a unique process.

Hitherto, there have been available alloys having good magnetic permeability, which could be readily shaped or formed, as for example, into relatively thin strip for use in making laminations or shields, but such materials were mechanically soft and, when used to make such products as laminated recorder heads or recorder head shields, were subject to excessive wear. On the other hand, other magnetic materials having physical hardness for good wear resistance and which also had good permeability were generally brittle and difficult to shape or form.

Numerous attempts have been made to provide products combining good magnetic properties with hardness or wear resistance using powder starting materials and techniques, but they have left much to be desired. For example, Gabriel et al U.S. Pat. No. 3,814,598 granted June 4, 1974 relates to a powder metallurgy method of producing a hot consolidated ferrous alloy magnetic pole piece from a ferrous alloy powder containing from about 2 to 12% silicon, 2 to 12% aluminum, 2000 to 8000 ppm oxygen and the balance iron in which the oxygen is added by thermally oxidizing the silicon-aluminum-iron alloy. Alexander et al U.S. Pat. No. 3,087,234 granted Apr. 30, 1963 relates to iron group metals having submicron particles of refractory oxides dispersed therein consisting of a metallic component selected from the group consisting of iron, cobalt, nickel and alloys thereof with each other and with other metals which form a nonrefractory oxide and having 0.5 to 50% by volume of a refractory metal oxide dispersed therein. The refractory metal oxide is defined in the patent as having a free energy of formation at 1000° C above 60 kilocalories per gram atom of oxygen, having a melting point above 1000° C, and having an average dimension of 5 to 1000 millimicrons. The patent (Col. 3) indicates twenty different oxides, including $Al_2O_3$, as being typical single refractory oxides useful in the composition of that patent. Alexander et al point to the difficulties which attend the incorporation of refractory oxides in metal bodies prepared by using the techniques of powder metallurgy and disclose a method in which the metal in an oxidized state is precipitated as a coating on refractory oxide particles having an average size of 5 to 1000 millimicrons, the coating being reduced by heating below the sintering temperature before the whole is sintered.

Ferromagnetically soft alloys are characterized by relatively high magnetic permeability and relatively low coercive force. It has long been recognized that such alloys were highly sensitive to impurities both with regard to their attainable magnetic properties and the processing required to bring out such properties. It is, therefore, critical in the manufacture of articles such as strip, from which magnetic devices are to be fabricated, that such articles be substantially free of impurities and imperfections which would adversely affect the required magnetic properties. In this regard, with respect to articles made from powder, it is to be noted that less than 100% theoretical density indicates residual voids, and whether or not filled with gas such voids, depending upon their size and occurrence, have an undesired effect on magnetic properties such as permeability similar to that of nonmagnetic inclusions of corresponding size. Consequently, for magnetic devices, such articles should have a density which differs, if at all, from 100% theoretical by no more than an insignificant amount. That is, the density of the finished article or the residual voids present therein should leave the article with at least a minimum level of magnetic properties required of such articles.

SUMMARY OF THE INVENTION

It is, therefore, a principal object of the present invention to provide a shaped article, such as strip, formed from composite material made up of a combination of metallic powder and a refractory oxide powder so that the shaped article has a unique combination of formability, wear resistance and magnetic properties.

A more specific object is to provide such a shaped article which is magnetically soft, has a relatively high initial permeability combined with an unusual degree of wear resistance and workability, and in which the refractory oxide component is aluminum oxide.

Yet another object is to provide a process for making such shaped articles as strip from a mixture of metallic powder and refractory oxide powder having a unique combination of magnetic and wear-resistance properties.

To a large extent, the foregoing are achieved in accordance with the present invention by blending powders of nickel, iron or alloys thereof and a refractory metal oxide. Selected amounts of one or more of the elements chromium, molybdenum, copper, manganese, titanium and niobium can be included. Blending is carried out to provide a substantially homogeneous distribution throughout the mass which is then heated in a reducing atmosphere at a high enough temperature for a long enough time to deoxidize the matrix metal but not the aluminum oxide and to alloy the matrix metal when elemental powders are used. The material is then worked to the desired shape, e.g. strip, which is then formed into finished products such as laminated recorder heads and recorder head shields.

DESCRIPTION OF THE DRAWING

The drawing is a graph showing the effect of an addition of 0–2% aluminum oxide on the properties of a preferred matrix composition prepared in accordance with the present invention. By unit wear resistance is meant the wear resistance of the matrix composition in the same condition but without any $Al_2O_3$ addition. Impedance permeability is plotted from measurements made on material having the same preferred matrix composition and in the form of rings made from 0.014 inch (0.036 cm) thick strip.

DESCRIPTION OF THE PREFERRED EMBODIMENTS

Powders, preferably of high purity, are blended in the proportion of about 70 to 85% nickel and more than 10% iron. To provide desired modification of electrical and magnetic properties, there is included one or more 0 to 5% chromium, 0 to 6% molybdenum, 0 to 6% copper, 0 to 2% manganese, 0 to 1% titaniun, and 0 to 1% niobium. The particle size of the metal powders is not at all critical, but the particles should not be so large as to prevent alloying when elemental powders are used and the formation of a substantially homogeneous matrix following blending and sintering. Preferably, small particles are used, less than 325 mesh (U.S. Sieve Series). To the amounts of the metal powders required to give the desired alloy composition in the finished article there is added a quantity of refractory oxide in the form of aluminum oxide ($Al_2O_3$) powder. The aluminum oxide powder particle size must not be so large as to interfere with the shaping and forming operations required to be carried out to provide the desired finished article. It is essential that the minimum size of the aluminum oxide particles be large as compared to the domain or Bloch wall thickness in the magnetic matrix. To this end, the minimum particle size of the aluminum oxide powder should be greater than about 1 micron. Particles up to about 50 microns can be used, but because of the extreme hardness of the aluminum oxide particles, they should be smaller than the thickness of the final product. Particle sizes of from 1 to about 25 microns are preferred.

To provide the best combination of wear resistance and high initial permeability, the amounts of metal powder which form the magnetic matrix and aluminum oxid which provides the wear resistance are proportioned so that aluminum oxide forms about 0.75 to 1.20% of the whole. Effective results can be achieved with as much as 2.0% aluminum oxide where the primary consideration is wear resistance, the accompanying magnetic properties are adequate for the intended use, and the formability of the composite material permits economic production of the finished shape. An aluminum oxide content of about 0.5% was found to give outstanding results, better than 3 times the wear resistance of the same matrix composition but without the addition of aluminum oxide. In similar tests, increasing the proportion of aluminum oxide to about 1.0% increased wear resistance to more than 4 times that of the same magnetic matrix but with no aluminum oxide addition. With as little as 0.10% aluminum oxide added the material provided about a twofold increase in wear resistance over the same magnetic matrix. As is apparent from the drawing, a unique combination of initial permeability and wear resistance is provided by the present invention. It mau also be well to note here that when the articles incorporate air gaps, as for example the two air gaps present in conventional magnetic recorder heads, the magnetic impedance of the articles is substantially increased with the result that the larger amounts of aluminum oxide of about 1.5% and up to about 2% can be used in such articles to provide heads having exceptional wear resistance with only a very small sacrifice in apparent initial permeability.

The selection of the aluminum oxide powder particle size greater than 1 micron is a critical feature of the present invention as is also the 99% or more of theoretical density (as defined hereinafter) which results from the manner in which densification is carried out. These unique features ensure that the magnetic properties, particularly initial permeability, are preserved to a unique degree. Initial permeability (measured at 40 gauss) of shaped articles 0.014 inch thick as heat treated is at least 4000 gauss per oersted with as much as up to about 1.5% $Al_2O_3$ and better than 3000 gauss per oersted with as much as 2.0% at frequencies from 0 to less than 1000 hertz. In thicknesses of 0.006 inch or less, more than 4000 gauss per oersted can be had with 2% $Al_2O_3$. The saturation induction ($B_s$) of the shaped articles produced in accordance with the present invention from a magnetizing force of 10 oersteds is greater than 6.0 kilogauss.

Shaped articles are made in accordance with the process of the present invention preferably by blending elemental metal powders and aluminum oxide powder of the desired particle size. Prealloyed metal powders made from alloys of the desired composition (except for the aluminum oxide) can also be used but such powder made by atomizing the molten alloy using water as the atomizing fluid is preferred. The blending of the powders is carried out long enough to provide a highly uniform blend, care being taken to avoid contamination. For example, when blending is carried out in a ball mill, nickel balls can be used. To facilitate handling, green compacts are preferably prepared from the blended powder by compacting preliminary shapes of the blended material under pressure. The pressure is not critical and, as a practical matter, is determined by the size and shapes desired and the equipment available. Depending upon handling requirements, the pressure used in compacting can vary from no more than the force of gravity to more than 100,000 psi. The green shapes are preferably sintered at a high enough temperature for a long enough time in a reducing atmosphere to provide substantially complete deoxidation and substantially maximum increase in density over the green shapes. When a blended mixture made up of prealloyed metal powders is sintered, pressure can be used to decrease the time required. However, in the case of elemental metal powders the long sintering times are required to permit complete alloying and homogenization to take place.

In carrying out the sintering step of the present process, a temperature as close to the melting temperature of the elemental metal powders and their alloy is preferred in the case of elemental metal powders to facilitate alloying of the elemental powder particles which takes place during sintering to provide a substantially homogeneous body. However, lower temperatures can be used and a temperature of about 2150° F (about 1175° C) has been used. When prealloyed metal powders are used, less sintering time is needed. It is preferred to sinter at a temperature above the hot working temperature of the material and in most instances, it is preferable not to use a temperature below about 2200° F (about 1200° C). Consistently good results are obtained by sintering at about 2300° to 2400° F (about 1260° to 1320° C) and somewhat higher temperatures can be used. In some instances, it may be desirable to combine sintering with heating for hot working. Sintering is preferably carried out in a reducing atmosphere such as hydrogen or dissociated ammonia. Though not preferred, an inert atmosphere such as vacuum or argon can be used particularly when sufficient amounts of carbon and oxygen are present in the starting materials and are available to provide carbon monoxide in sufficient quantity to ensure that any matrix metal oxides present are reduced.

As was noted hereinabove, alloying of the elemental metal powders takes place during the sintering step of the present process. Thus, sintering should be carried out for a long enough time to ensure substantially complete alloying and homogenization to take place. In addition to alloying, the mass is also degassed with the residual gas filled voids tending to agglomerate. It is a desirable feature of this invention that the conditions under which sintering is carried out, favors agglomeration of the residual voids so that they are larger than the domain or Bloch wall thickness. The time required for sintering is temperature and pressure dependent, the higher temperatures and pressures requiring less time. The size of the green body being sintered must also be taken into account. Thus, for relatively small bodies made from elemental powder, about 3 hours at about 2300° F (about 1260° C) may be long enough. In practice, the optimum duration for a given size at a selected temperature can be readily determined and a convenient approximate indication of completion of sintering is provided by the accompanying shrinkage or densification. For example, in the case of slabs rectangular in cross section the reduction in cross sectional area may be about 20% when sintering at no more than atmospheric pressure. It should also be noted that the powder shapes in the green compacted condition have a density of less than about 80% of theoretical density where theoretical density is defined as the density of the alloy matrix made up of the elements in the same proportions as are in the compact but prepared using conventional melting techniques. The density following sintering and before application of any forces other than atmospheric pressure is greater than 90% of theoretical, while following working the density is at least 99.0% of theoretical, which is to say that substantially full theoretical density is achieved by working from the as-sintered condition.

Following sintering, the preliminary shape is worked to complete densification and to provide the desired shaped article. Hot working is carried out from a temperature of about 2200°-2350° F (about 1200°-1290° C) down to a thickness of about 0.25 inch (about 0.64 cm) or less and preferably to a thickness of no more than about 0.1 inch (about 0.25 cm) from which the material is cold worked to the finished thickness. Intermediate annealing between reductions is carried out as required, usually at a temperature above about 1950° F (about 1065° C) although temperatures as low as about 1850° F (about 1010° C) could be used. In some instances, as when the sintered material is no thicker than about 0.25 inch (0.64 cm) densification to 99.0% or more of theoretical density can be carried out by cold working and without hot working.

Example A and Examples 1-6 of the present invention were prepared by blending 16 lbs nickel, 3 lbs iron and 1 lb of molybdenum elemental powders until substantially homogeneous. The particle size of the nickel and iron powders was about 5 to 20 microns and the particle size of the molybdenum powder was small enough to pass a 325 mesh sieve. The blended powder was divided into seven parts. Aluminum oxide powder having a preponderance of 2 to 5 micron particles with some small amount of larger particles less than 10 microns and about 1% or less just below 1.25 microns was added to Examples 1-6 to provide mixtures containing the following proportions of aluminum oxide:

| Ex. No. | A | 1 | 2 | 3 | 4 | 5 | 6 |
|---|---|---|---|---|---|---|---|
| w/o $Al_2O_3$ | 0 | 0.1 | 0.2 | 0.5 | 1.0 | 1.5 | 2.0 |

After blending, 2 inch (50.8 mm) diameter by about 0.17 inch thick (4.32 mm) coupons were compacted under a pressure of about 132,000 psi. The coupons were then sintered for 4 hours at 2400° F (1315° C) in dry hydrogen. After sintering, the coupons were cold rolled to 0.050 inch (1.27 mm) thick, annealed at 2150° F (1175° C) in dry hydrogen for 5 hours and cold rolled to 0.014 inch (0.36 mm) thick with an intermediate anneal at 1850° F (1010° C) at 0.025 inch (0.64 mm) thickness. Ring laminations 1.5 inch (3.81 cm) outer diameter and 1 inch (2.54 cm) inner diameter for permeability measurements and 1.5 $cm^2$ coupons for wear tests were made. All parts were annealed for 4 hours at 2150° F (1175° C) in dry hydrogen and cooled at a rate of 300° F per hour. The results of impedance permeability (40G, 60 and 1000 hertz), saturation induction (H = 100 Oe) and wear tests are listed in Table I. Permeability and wear curves based on the data are shown in the drawing.

The wear resistance is plotted with the amount of wear of Example A, the matrix analysis without the addition of aluminum oxide, as the unit of wear resistance to facilitate comparison. For measuring the wear, the 1.5 $cm^2$ coupons were glued to steel slugs and the wear resistance of each was determined by pressing the surface against triple 0 emery paper under a load of 3 lbs (1.36 kg) for 250 turns.

TABLE I

| Ex. No. | $Al_2O_3$ % | IMP. PERM. AT 40G (kG/Oe) 60Hz | $10^3$Hz | $B_{100\ Oe}$ (kG) | WEAR Ex. A=1 |
|---|---|---|---|---|---|
| A | 0.0 | 36.2 | 9.9 | 8.04 | 1.0 |
| 1 | 0.1 | 25.1 | 8.3 | 8.02 | 1.9 |
| 2 | 0.2 | 18.0 | 7.0 | 8.12 | 2.75 |
| 3 | 0.5 | 9.8 | 5.6 | 8.12 | 3.7 |
| 4 | 1.0 | 5.4 | 4.3 | 7.90 | 4.4 |
| 5 | 1.5 | 3.9 | 3.4 | 7.90 | 4.8 |
| 6 | 2.0 | 3.0 | 2.7 | 7.78 | 5.0 |

The present invention provides articles having an outstanding combination of wear resistance and magnetic properties over a wide range of compositions. Examples 1-6 illustrate one intermediate range containing about 78 to 82% nickel, 4 to 5.25% molybdenum, and the amounts of aluminum oxide previously indicated hereinabove and the balance iron plus incidental amounts of carbon, manganese, silicon and other impurities. Preferably 0.30% to 1.5% or for better all around properties 0.7 to 1.2% aluminum oxide is used. Another intermediate range differs from the foregoing in containing about 75 to 80% nickel, 3 to 4.5% molybdenum and 1.5 to 3% chromium. Yet another composition differs from this last by an addition of 3 to 5.5% copper and has no addition of molybdenum. It may also be well to note that carbon is an undesired impurity and, in the finished article such as a recorder head, is less than 0.005%. This low level is usually attained by the final annealing treatment carried out by the product manufacturer. At an intermediate stage, the carbon content may be somewhat higher, but, just before the final anneal, should be less than about 0.025%.

Here and throughout this application, all compositions are given in weight percent. In stating broad and preferred composition ranges of the various elements, it is not intended to be limited thereby to the stated combinations of minimum and maximum values and it is intended that the upper and/or lower limits of one or more of the elements and the refractory oxide can be used with the lower or upper limits of any one or more of the elements and the refractory oxide. The terms and expression which have been employed are used as terms of description and not of limitation, and there is no intention in the use of such terms and expressions of excluding any equivalents of the features shown and described or portions thereof, but it is recognized that various modifications are possible within the scope of the invention claimed.

What is claimed is:

1. A ferromagnetically soft wear-resistant shaped article made from metal powder in which a refractory oxide powder is substantially uniformly dispersed therein having a minimum particle size greater than about 1 micron which is large compared to the Block wall thickness in the composition of said article, the composition of said article consisting essentially of about

| | Weight Percent |
|---|---|
| Carbon | <0.025 |
| Manganese | 0–2 |
| Nickel | 70–85 |
| Chromium | 0–5 |
| Molybdenum | 0–6 |
| Copper | 0–6 |
| Titanium | 0–1 |
| Niobium | 0–1 |
| Refractory oxide | 0.1–2.0 |

the balance being essentially iron and incidental impurities with the iron content being greater than 10%, said article having a density at least 99% of theoretical with residual voids being larger than the Block wall thickness.

2. The article of claim 1 in which the refractory oxide is aluminum oxide and has a particle size greater than 1 micron up to about 50 microns but less than the smallest dimension of the article and products made therefrom.

3. The article of claim 2 having a composition containing about 0.7 to 1.20% aluminum oxide.

4. The article of claim 2 having a composition containing about 0.5% aluminum oxide.

5. The article of claim 2 having a composition containing no more than about 1.5% aluminum oxide.

6. The article of claim 2 formed with at least one air gap.

7. The article of claim 2 having a composition containing about 1% aluminum oxide.

8. The article of claim 2 having a composition containing about 78 to 82% nickel, about 4 to 5.25% molybdenum, about 0.1 to 2.0% aluminum oxide, and in which the balance consists essentially of iron and incidental impurities.

9. The article of claim 8 containing about 0.7 to 1.20% aluminum oxide.

10. The article of claim 8 containing about 0.5% aluminum oxide.

11. The article of claim 8 containing about 1.0% aluminum oxide.

12. The article of claim 8 containing no more than about 1.5% aluminum oxide.

13. The article of claim 2 having a composition containing about 75 to 80% nickel, 3 to 4.5% molybdenum, 1.5 to 3% chromium, about 0.1 to 2.0% aluminum oxide, and in which the balance consists essentially of iron and incidental impurities.

14. The article of claim 2 having a composition containing about 75 to 80% nickel, 3 to 5.5% copper, 1.5 to 3% chromium, about 0.1 to 2.0% aluminum oxide, and in which the balance consists essentially of iron and incidental impurities.

15. A process for making a ferromagnetically soft wear-resistant shaped article which includes the steps of blending metal powder and a refractory oxide powder having a minimum particle size greater than about 1 micron that is large compared to the Bloch wall thickness in the composition of said article to provide a substantially homogeneous mixture in such proportions that the composition of the article in its sintered and densified condition in weight percent consists essentially of about

| | Weight Percent |
|---|---|
| Carbon | <0.025 |
| Manganese | 0–2 |
| Nickel | 70–85 |
| Chromium | 0–5 |
| Molybdenum | 0–6 |
| Copper | 0–6 |
| Titanium | 0–1 |
| Niobium | 0–1 |
| Refractory oxide | 0.1–2.0 |

the balance being essentially iron and incidental impurities with the iron content being greater than 10%, then forming a preliminary shape from the blended powders, sintering the preliminary shape at a high enough temperature and for a long enough time in a reducing or inert atmosphere to provide a substantial amount of densification without reducing or melting the refractory oxide, and then working the sintered shape and reducing the thickness thereof to provide a shaped article having at least 99% theoretical density and in which the metal elements present except that combined to form refractory oxide are fully alloyed and homogeneously distributed.

16. The process set forth in claim 15 in which the metal powders are elemental powders.

17. The process set forth in claim 16 in which sintering is carried out at a high enough temperature and long enough so that the elemental metals present are fully alloyed.

18. The process set forth in claim 17 in which the refractory oxide powder is aluminum oxide and has a particle size greater than 1 micron up to about 50 microns but less than the smallest dimension of said article and products and therefrom.

19. The process set forth in claim 18 in which the aluminum oxide particles range from 1 to about 25 microns.

20. The process set forth in claim 18 in which the preliminary shape is sintered at a temperature from 2150° F to just below the melting temperature of the elemental metal powders.

21. The process set forth in claim 20 in which sintering is carried out at a temperature above about 2200° F.

22. The process set forth in claim 20 in which sintering is carried out at a temperature up to about 2400° F.

23. The process set forth in claim 22 in which sintering is carried out at a temperature above about 2300° F.

24. The process as set forth in claim 20 in which residual voids present in the sintered preliminary shape are larger than the Bloch wall thickness.

25. The process as set forth in claim 20 in which said preliminary shape before sintering has a density less than about 80% of theoretical density, and the density following sintering and before working is greater than 90% of theoretical density.

26. The process as set forth in claim 25 in which hot working is carried out to a reduction in thickness of the sintered preliminary shape to at least 0.25 inch.

27. The process as set forth in claim 26 in which hot working is carried out to a reduction in thickness to at least about 0.1 inch.

28. The process as set forth in claim 27 in which reduction of the preliminary shape to the thickness of the article is completed by cold working.

29. The process as set forth in claim 25 in which a preliminary shape in its sintered condition having a thickness not greater than about 0.25 inch is cold worked to reduce its thickness to that of the shaped article with a density of at least 99% of theoretial.

* * * * *

UNITED STATES PATENT OFFICE
CERTIFICATE OF CORRECTION

PATENT NO. : 4,069,043
DATED : January 17, 1978
INVENTOR(S) : Friedrich W. Ackermann It is certified that error appears in the above-identified patent and that said Letters Patent are hereby corrected as shown below:

Col. 1, lines 49-50 for "composition" read --compositions--
Col. 2, line 66, after "more" insert --of--.
Col. 3, line 26, for "oxid" read --oxide--.
Col. 3, line 28, for "0.75" read --0.7%--.
Col. 3, line 47, for "mau" read --may--.
Col. 6, line 66, for "expression" read --expressions--.
Col. 7, Pat. claim 1, lines 5 & 22, for "Block" read --Bloch--.
Col. 8, Pat. claim 18, line 5, after products, for "and" read --made--.
Col. 10, Pat. claim 29, last line for "theoretial" read --theoretical--.

Signed and Sealed this
*Twenty-seventh* Day of *June 1978*

[SEAL]

*Attest:*

RUTH C. MASON
*Attesting Officer*

DONALD W. BANNER
*Commissioner of Patents and Trademarks*